US009243767B2

(12) United States Patent
Danner et al.

(10) Patent No.: US 9,243,767 B2
(45) Date of Patent: Jan. 26, 2016

(54) LED LIGHT MODULE

(75) Inventors: Markus Danner, Ollersdorf (AT); Helmut Erdl, Flintsbach (DE)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 0 days.

(21) Appl. No.: 13/983,218

(22) PCT Filed: Dec. 13, 2011

(86) PCT No.: PCT/AT2011/050038

§ 371 (c)(1),
(2), (4) Date: Aug. 1, 2013

(87) PCT Pub. No.: WO2012/109681

PCT Pub. Date: Aug. 23, 2012

(65) Prior Publication Data

US 2013/0308329 A1 Nov. 21, 2013

(30) Foreign Application Priority Data

Feb. 16, 2011 (AT) ..... A 206/2011

(51) Int. Cl.
*F21S 8/10* (2006.01)

(52) U.S. Cl.
CPC ..... *F21S 48/115* (2013.01); *F21S 48/1154* (2013.01); *F21S 48/1233* (2013.01); *F21S 48/1241* (2013.01); *F21S 48/1329* (2013.01); *F21S 48/1747* (2013.01)

(58) Field of Classification Search
CPC . F21S 48/115; F21S 48/1154; F21S 48/1233; F21S 48/1241
USPC ..... 362/465, 538, 539, 522, 509, 511, 362/543–545, 555, 459–549
See application file for complete search history.

(56) References Cited

U.S. PATENT DOCUMENTS 7,117,335 B2 * 10/2006 Sailer et al. ..... 711/173
7,156,544 B2 * 1/2007 Ishida ..... 362/538

(Continued)

FOREIGN PATENT DOCUMENTS

DE 102007019115 A1 * 11/2007

OTHER PUBLICATIONS

Machine Translation DE 102007019115 A1.*

*Primary Examiner* — Evan Dzierzynski
*Assistant Examiner* — Christopher E Dunay
(74) *Attorney, Agent, or Firm* — Sutherland Asbill & Brennan LLP

(57) ABSTRACT

The invention relates to an LED light module (1) for a motor vehicle or for a headlamp for a motor vehicle, wherein the light module (1) comprises a lens (2) and at least one primary LED light source (8). A light tunnel (11) for direct passage of at least a portion of the light emitted from the at least one primary LED light sconce (8) is provided between the at least one primary LED light source (8) and the lens (2), viewed in the direction of the light emission. The light of the at least one primary LED light source (8) emerging through the light tunnel (11) is projected via the lens (2) to generate a main beam function or a contribution to a main beam function in the region in front of the motor vehicle. The light tunnel (11) is formed from a material that is transparent at least in some areas, preferably in the whole area thereof, and a holder (3) for holding the light tunnel (11) is provided, wherein the holder (3) is transparent at least in some areas, preferably completely transparent. At least one secondary LED light source (9) is provided and is arranged in such a way in relation to the light tunnel (11) that the light emitted from the at least one secondary LED light source (9) is emitted substantially onto the holder (3), and wherein the wall (10', 11', 12') bounding the light tunnel (11) is light-reflecting at least in some areas.

32 Claims, 4 Drawing Sheets

(56) References Cited

U.S. PATENT DOCUMENTS

Figure 1:
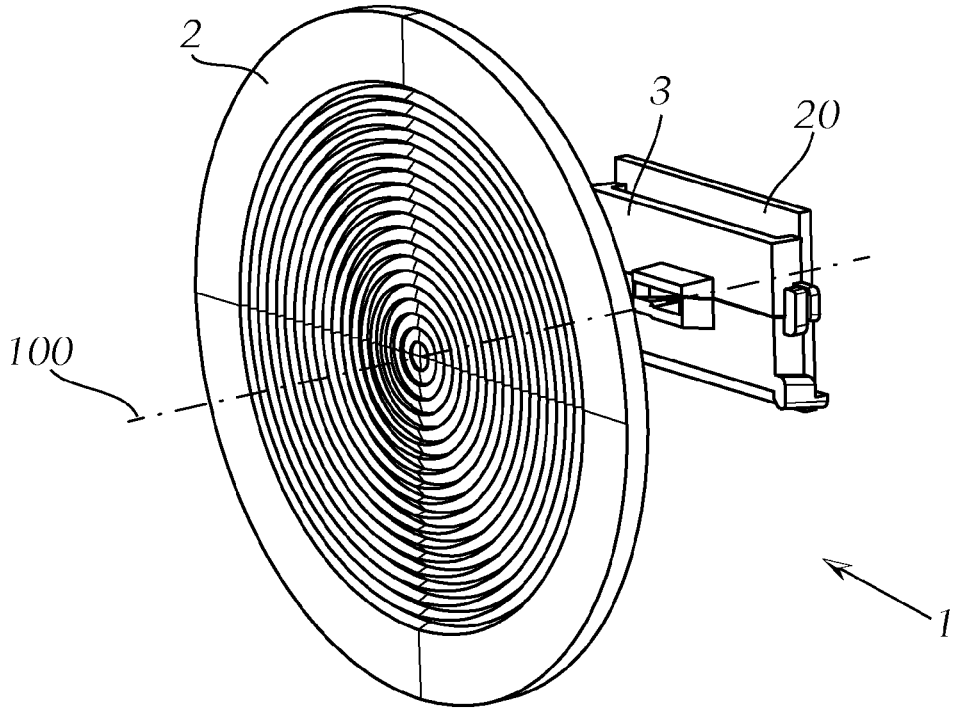

| | | | | |
|---|---|---|---|---|
| 8,007,152 | B2 * | 8/2011 | Nakabayashi | 362/538 |
| 2004/0120160 | A1 * | 6/2004 | Natsume | 362/544 |
| 2004/0223338 | A1 * | 11/2004 | Koike et al. | 362/545 |
| 2007/0279910 | A1 * | 12/2007 | Lin | 362/298 |
| 2010/0309681 | A1 * | 12/2010 | Ohno | 362/543 |
| 2011/0157906 | A1 * | 6/2011 | Oeuvrard et al. | 362/488 |
| 2011/0170309 | A1 * | 7/2011 | Doring et al. | 362/516 |
| 2011/0260616 | A1 * | 10/2011 | Chaterlea et al. | 315/82 |
| 2011/0280031 | A1 * | 11/2011 | Luger et al. | F21S 48/1154 362/520 |

* cited by examiner

LED LIGHT MODULE

CROSS-REFERENCE TO RELATED APPLICATIONS

This application is the national stage of International Application No. PCT/AT2011/050038, filed Dec. 13, 2011, and claims priority benefit of Austrian Patent Application No. A 206/2011, filed Feb. 16, 2011. These applications are incorporated by reference herein.

The invention relates to an LED light module for a motor vehicle or for a headlight for a motor vehicle, wherein the light module comprises a lens and at least one primary LED light source, wherein, as viewed in the light outlet direction, a light tunnel is provided between the at least one primary LED light source and the lens for the direct passage of at least a portion of the light emitted from the at least one primary LED light source, wherein the light, exiting through the light tunnel, of the at least one primary LED light source is projected via the lens into the region in front of the motor vehicle to generate a main-lighting function or a contribution to a main lighting function.

The light emitted by such a primary LED light source, for example a high-power LED light source (for example LUMILED Altillin Core or OSTAR Headlamp) can be shaped by means of a light tunnel and projected via a lens, for example a free-form lens, aspherical lens, or Fresnel lens, onto the road, where it forms a main light distribution, for example a dipped headlight beam distribution, or a contribution to such a main light distribution. The overall light distribution is produced for example by use of a plurality of such light modules or different light modules. Such a primary LED light source for example comprises a plurality of light-emitting diodes, for example four light-emitting diodes. Due to the use of a light tunnel, which has a specific length, it is ensured that the light of the individual light-emitting diodes is well mixed and that the necessary homogeneous light distribution is thus produced.

The object of the invention is to also produce a secondary lighting function or a contribution to a secondary lighting function with such a headlight or light module, wherein it is to be ensured that no alternating influences of the different light exposures occur as a result, and in particular that the main light distribution is not impaired, for example as a result of undesirable interfering radiation, which may be problematic in particular in the case of dipped light distributions. The interfering radiation may specifically cause an increase in the glare value. This increase in the glare value is not permissible for dipped light effects (for example dipped headlight beam, motorway light, . . . , described for example in the ECE R 123 or SAE regulation) if it is above the legal values.

This object is achieved with an LED light module as mentioned in the introduction in that, in accordance with the invention, the light tunnel is formed from a material that is transparent at least in some areas and preferably over the entire area, a holder for holding the light tunnel is provided, wherein the holder is transparent at least in some areas and preferably completely, and wherein at least one secondary LED light source is provided, which is arranged with respect to the light tunnel in such a way that the light emitted from the at least one secondary LED light source is emitted substantially onto the holder, and wherein the wall defining the light tunnel is light-reflective, at least in some areas.

The light tunnel itself has a function that shadows the secondary lighting function, whereby no legally conforming light distribution would be produced for the secondary lighting function. For this reason, the light tunnel is formed from a transparent material.

Since the light tunnel itself is likewise formed from a transparent material, wherein the light in the tunnel is preferably guided further by means of total reflection, there is the risk however that light from the light tunnel will pass into the transparent holder and thus cause undesirable or legally inadmissible interfering radiation, which in particular may then often be the case when the main lighting function is a dipped lighting function, such as a dipped headlight beam function.

Due to the embodiment according to the invention of the wall of the light tunnel, which is light reflective at least in the relevant areas, the risk of interfering radiation can be eliminated however, such that, even in the case of a light module with which two lighting functions can be produced, these can be produced in a legally conforming manner.

The term "in some areas" means that the wall is reflective only at specific points, in particular those points of the wall where light from the at least one primary LED light source can reach the light tunnel and from there the holder.

Even if the light tunnel forwards the light inside by means of total reflection, it may of course be that light can enter the material forming the light tunnel and can lead to interfering rays, in particular if the light can also reach the holder.

As a result of the reflective embodiment (at least in some areas) of the inner wall of the light tunnel, this can be reduced or completely prevented.

The light of the secondary LED light sources infiltrates the body forming the light tunnel (the body practically constitutes an optical waveguide), and passes through the reflective coating, but not into the light tunnel. Even without the reflective embodiment, the delimiting wall of the light tunnel would of course also be totally reflective for light from the secondary LED light sources, however a certain percentage of the light would still enter the light tunnel. For the secondary lighting function, this would be unproblematic however, and the reflective embodiment of the light tunnel therefore is not necessary for the secondary lighting function, but does not interfere or only interferes to a negligible extent due to the very low spatial expansion (thickness).

In accordance with the invention, it is possible to produce a secondary light distribution by means of the at least one secondary LED light source. With the holder, the light tunnel is held in its position and the light originating from the at least one secondary LED light source can also pass through the holder and is imaged via the lens as secondary light distribution in an area in front of the vehicle.

In this case, the wall of the light tunnel is to be understood in particular to mean the inner wall of the light tunnel.

The holder is typically narrower than the longitudinal extent of the light tunnel. It is therefore primarily expedient if the wall of the light tunnel is light reflective at least in the area adjacent to the holder.

In order to optimally utilise the light flux, the at least one secondary LED light source is arranged with respect to the light tunnel, in particular with respect to the light inlet opening of the light tunnel, in such a way that substantially no light flux of the at least one secondary LED light source exits through the light tunnel.

The holder is normally clear, however the holder may also be formed at least in some areas as a diffuser in order to obtain a particularly homogeneous light exposure of the secondary light distribution.

The light tunnel or the light module is optimal from an optical viewpoint and can be manufactured in the simplest manner possible if the entire area of the wall of the light tunnel is light reflective.

Here, the wall of the light tunnel is primarily reflective at least in the wavelength range for visible light.

For example, the wall of the light tunnel is mirrored.

In a specific variant of the invention, the wall of the light tunnel is provided with a light-reflective layer in some areas or completely (that is to say over the entire area of the wall).

With regard to the possibility of simple production, it has proven to be expedient if the wall of the light tunnel is vapour-coated with the light-reflective layer in some areas or completely.

In view of simple, expedient manufacture, and also in view of a most exact construction possible of the light module, it is favourable if the light tunnel and the holder are formed in one piece.

For simple application of the reflective layer, it is in particular advantageous if the light tunnel and/or the holder or the one-piece holder/light tunnel element has/have a two-piece construction, wherein the separation planes between the two holder parts run through the light tunnel. The respective elements are joined at these two separation planes.

In particular, the two separation planes of the light tunnel and/or of the holder are also likewise light-reflective, preferably totally reflective, for which purpose the separation planes are provided for example with a light-reflective layer and are preferably vapour-coated with said reflective layer.

In particular, these separation planes are coated/vapour-coated within the sense of a simpler manufacturing process.

In terms of the optical function, it would be optimal if merely the light tunnel, that is to say the inner wall thereof, were vapour-coated/coated. However, in the case of a one-piece embodiment of the light tunnel, the light tunnel could only be optimally vapour-coated/coated with difficulty, since the corresponding mist, for example an aluminium mist, would only distribute uniformly and completely in the light tunnel with difficulty, whereby points having an excessively low coating thickness could be produced, which could in turn result in the risk of scattered light.

Accordingly, a two-part construction is selected, wherein a multi-part construction is also conceivable in principle, although this would increase the costs. Only the tunnel itself (on the inner face) has to be reflectively coated. In order to save complex masking operations (parts of the holder that are not to be coated would have to be covered), the entire separation area/end face is coated. This has only a small influence photometrically, since this coating is very thin.

In a specific embodiment of the LED light module according to the invention, substantially the entire emitted, optically relevant light flux of the at least one primary LED light source exits through the light tunnel in order to produce the main lighting function.

The term "relevant" light flux is to be understood to mean any light flux that can enter the lens via the light inlet surface of said lens, that is to say is not reflected and can therefore be used in principle for the lighting function. Depending on the embodiment, a light-emitting diode demonstrates specific radiation behaviour, and therefore some of the light beams (provided they are not deflected) are normally irradiated in a direction such that their angle of incidence on the light inlet surface of the lens is greater than what is known as the angular aperture of the lens, that is to say this light is reflected. Light from the LED light source that impinges at a greater angle than the angular aperture no longer constitutes "relevant" light flux.

In addition, the at least one secondary LED light source or all secondary LED light sources may lie outside the optical axis of the light module.

In order to achieve an optimal illumination, which is as homogeneous as possible, of the diffuser or an appearance, which is as homogeneous as possible, of the holder or of the holder formed as a diffuser and therefore of the light module, the at least one secondary LED light source may also additionally be arranged offset rearwardly with respect to the primary LED light source, against the light outlet direction. (In other words, the light outlet surfaces of the light sources are offset from one another).

With increased distance of the LED light source(s) of the secondary light source, a more homogeneous illumination of the holder/of the diffuser is achieved.

With respect to a homogeneous illumination of the holder, the primary LED light source also comprises two or more light-emitting diodes in accordance with an advantageous variant.

The number of light-emitting diodes that have to be used is dependent on the one hand on the strength of the light-emitting diodes and on the other hand on the light distribution that is to be produced.

It is also expedient if the at least one primary LED light source and the at least one secondary LED light source or the at least one light-emitting diode of the at least one primary LED light source and the at least one light-emitting diode of the at least one secondary LED light source can be controlled separately so that the primary light source and the secondary light source(s) can be switched on and switched off independently of one another.

Furthermore, the at least one primary LED light source is dimmed or switched off during operation of the at least one secondary LED light source.

In the case of secondary light, it is attempted to illuminate as far as the edge of the light tunnel where possible with the light of the secondary light sources; the primary LED light source is dimmed, but luminesces so that continuous illumination is produced and the light tunnel does not cause a dark patch in the light exposure of the secondary light. The lens projects precisely that light distribution which occurs in its focal plane. Light of the secondary LED light sources cannot enter the tunnel, and this would therefore appear dark and would be represented as a dark point in the light exposure if the primary LED light source(s) was/were not to luminesce continuously (albeit in a dimmed manner).

In the main light mode, only the at least one primary LED light source is generally switched on, and the secondary LED light sources are normally switched off. In the case of a main lighting function=main beam, the secondary LED light sources could also be continuously operated however in order to admit more light onto the road.

It is also advantageous if, when the light module is installed in a vehicle headlight, n secondary LED light sources are provided below a horizontal plane through the primary LED light source in the vertical direction, and m secondary LED light sources are provided above the horizontal plane in the vertical direction, wherein $m<n$.

Here, horizontal plane "through" the LED light source means that this plane runs through the LED of the LED light source or, in the case of a plurality of LEDs, runs through the geometric midpoint of these LEDs.

Since the lens of the light module is generally considered to be above this horizontal from viewing angles, it is advantageous if the number of LEDs in the lower region is increased, since this region is imaged into the angular region above the horizontal and an optically more pleasant illumination of the lens can thus be achieved.

In principle, a high number of LED light sources for the secondary light source would be optimal, but is restricted however by costs and available installation space of the headlight. In a simple, favourable variant of the invention, with which pleasant results with regard to the illumination can be achieved, m=0.

With regard to an illumination that is as uniform as possible, the secondary LED light source(s) is/are also arranged above or below the horizontal plane in each case symmetrically in the horizontal direction with respect to a vertical plane through the optical axis.

In addition, in this regard, further secondary LED light sources of the secondary light source may also be arranged laterally beside the primary LED light source, that is to say in a horizontal plane with the primary LED light source.

In order to utilise the light flux from the primary LED light source optimally, the dimensions of the light tunnel, such as diameter, side dimensions, length, etc., and/or the arrangement of the at least one primary LED light source with respect to the light tunnel and/or the distance of the at least one primary LED light source from the holder are also advantageously selected in such a way that all light rays emitted by the at least one primary LED light source lying within an angular aperture of the lens can pass through the light tunnel.

The expression "arrangement with respect to the light tunnel" is to be understood primarily to mean "with reference to the light inlet opening of the light tunnel".

It is further advantageous if the dimensions of the light tunnel, such as diameter, side dimensions, length, etc., and/or the arrangement of the at least one secondary LED light source with respect to the light tunnel and/or the distance of the at least one secondary LED light source from the holder are selected in such a way that light rays from the at least one secondary LED light source merely reach any areas of the holder that lie outside the light tunnel.

In this way, no secondary light can pass directly through the light tunnel.

It is particularly advantageous if the dimensions of the light tunnel, such as diameter, side dimensions, length, etc., and/or the arrangement of the at least one secondary LED light source with respect to the light tunnel, that is to say at its light inlet opening, and/or the distance of the at least one secondary light source from the holder are selected in such a way that light rays from the at least one secondary LED light source are radiated as far as the edge of the light inlet opening of the light tunnel.

Lastly, it may further also be advantageous if the light tunnel is filled with an optically transparent material, in particular with a material that is transparent in the range of visible light, for example with a silicone. The coating/vapour coating can thus be protected against external influences (moisture, dust, etc.), whereby the risk of detachment or corrosion of the coating/vapour coating can be avoided.

In addition, a filled light tunnel provides slightly higher light values (Emax) compared to an unfilled light tunnel, since light rays upon entry into optically denser media refract towards the normal, thus resulting in a concentration of the light rays.

Figure 2:
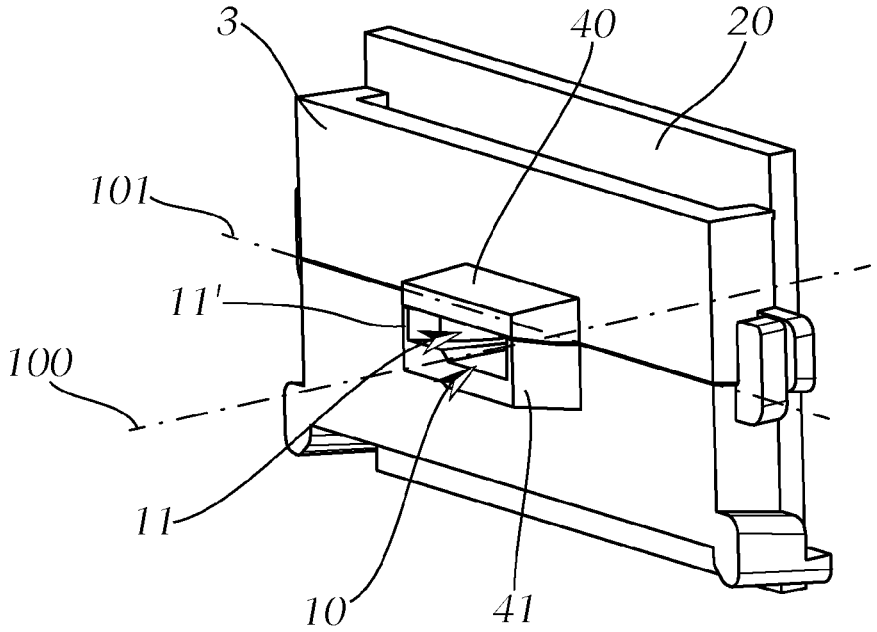
Figure 3:
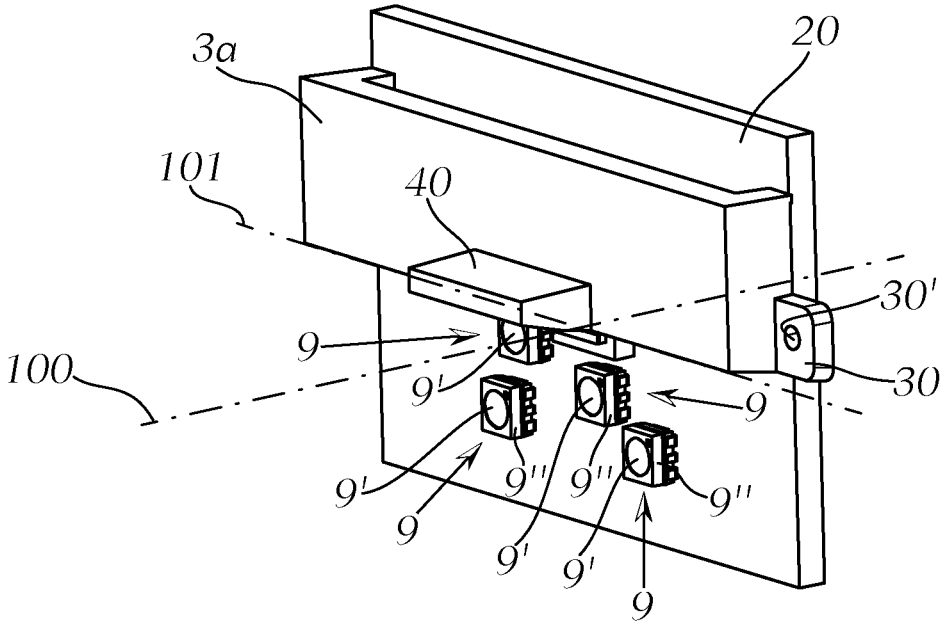
Figure 4:
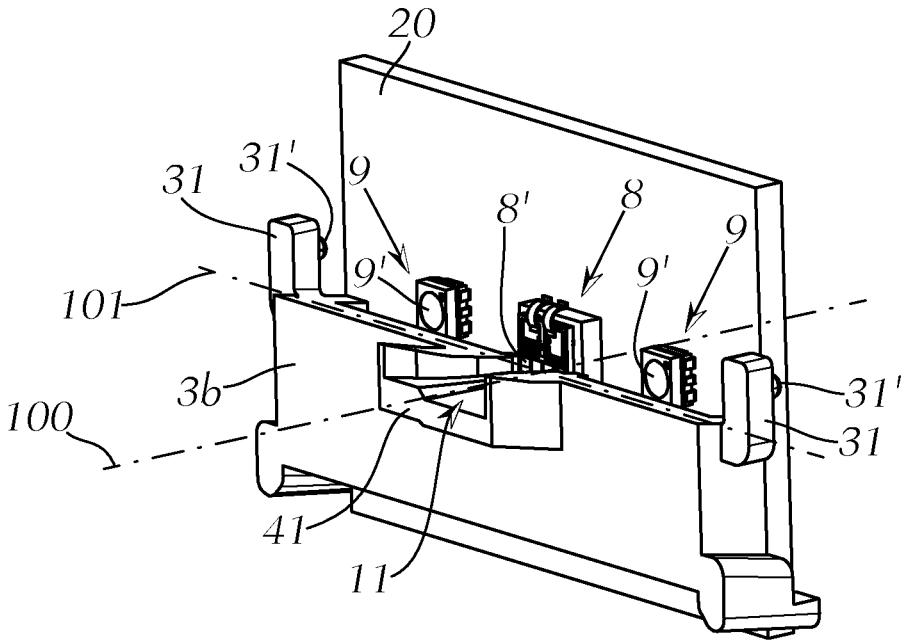
Figure 5:
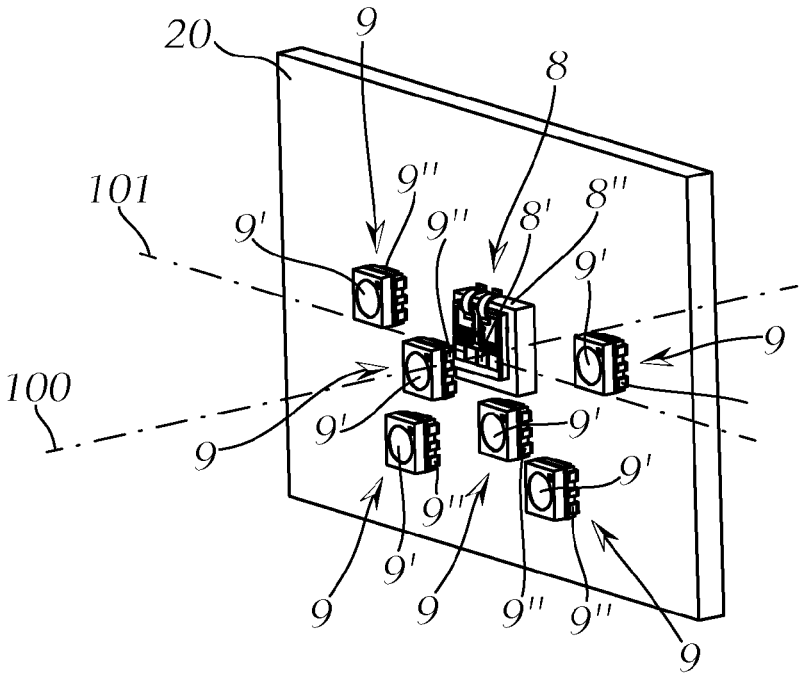
Figure 6:
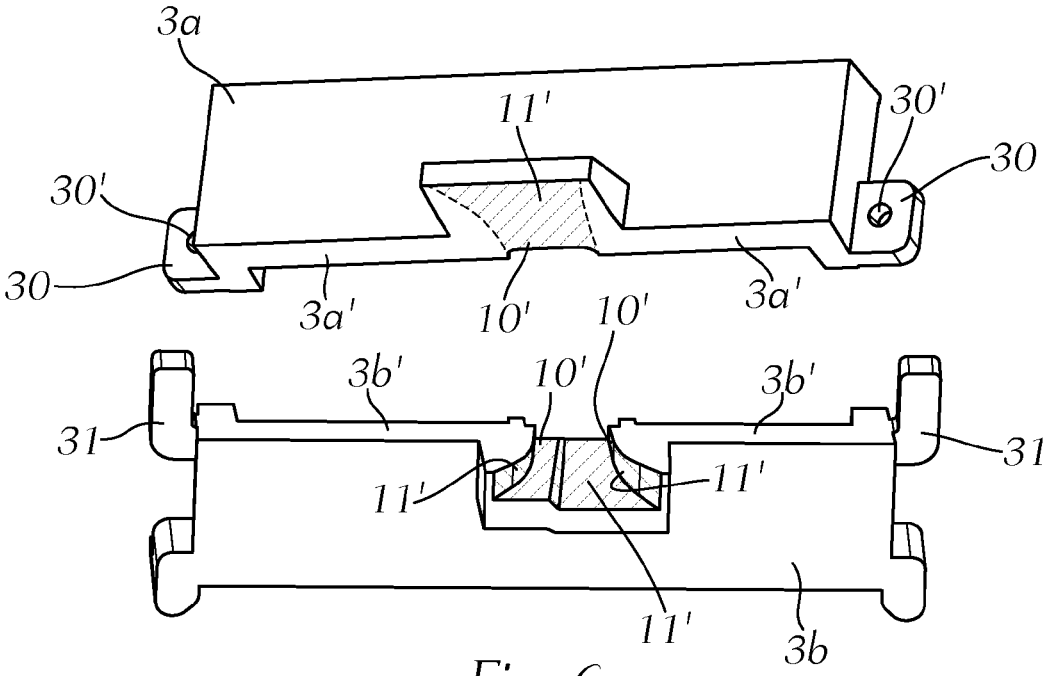
Figure 7:
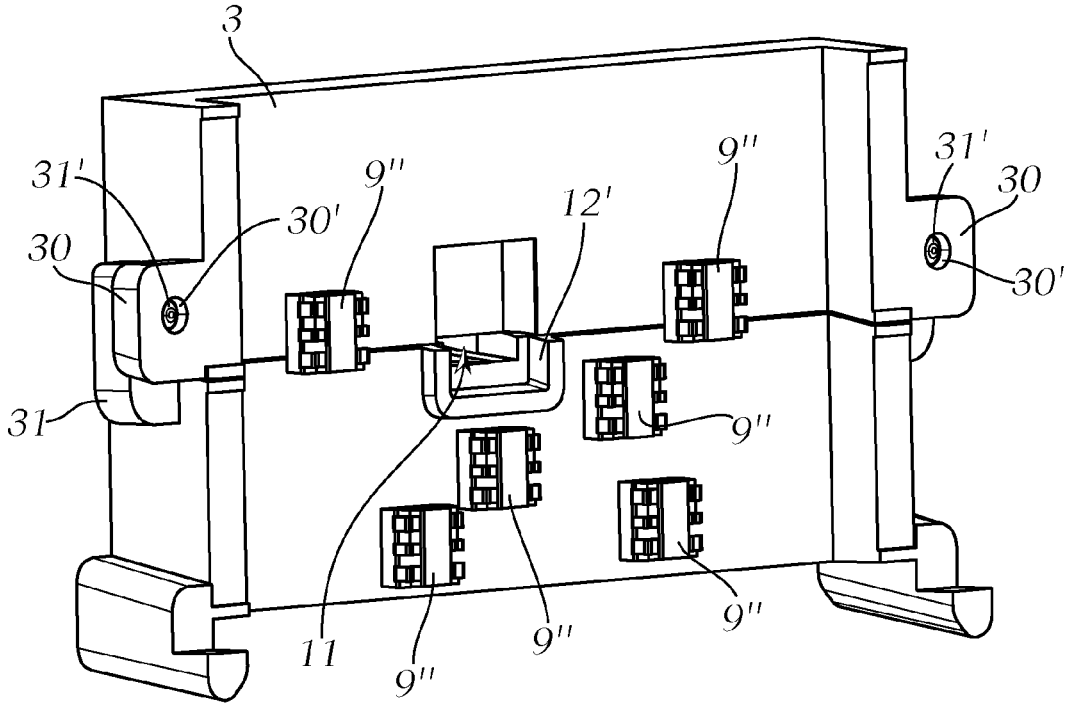
Figure 8:
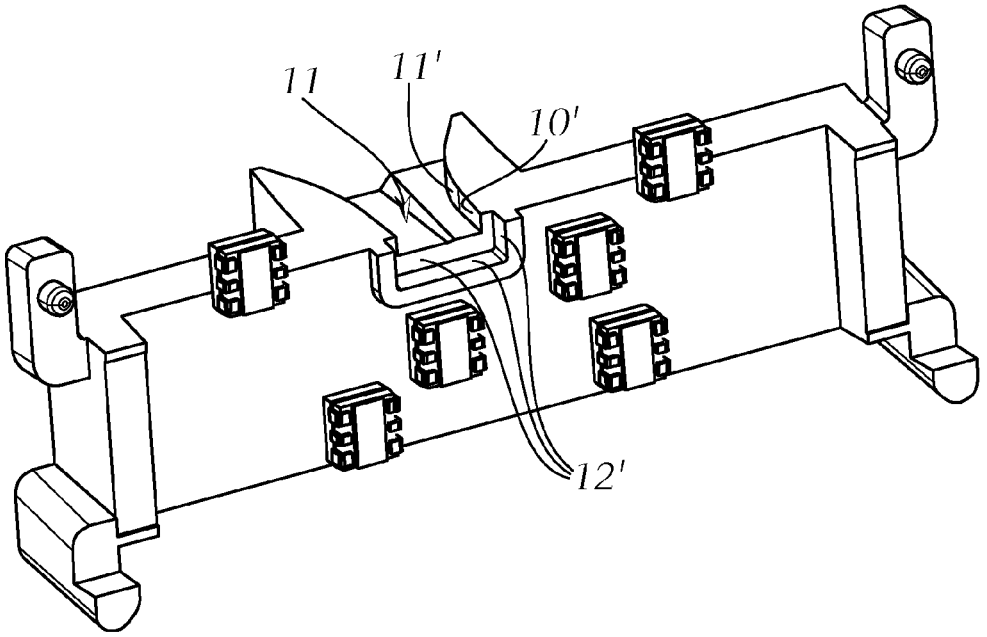

The invention will be explained in greater detail hereinafter on the basis of the drawings, in which FIG. 1 shows a schematic illustration of an LED light module according to the invention, FIG. 2 shows a schematic illustration of a light tunnel and holder, FIG. 3 shows the upper part of the light tunnel and holder from FIG. 2 with a view onto the LED print arranged therebehind, FIG. 4 similarly to FIG. 3, shows the lower part of the light tunnel and of the holder, FIG. 5 shows the LED print with primary and secondary LED light sources, FIG. 6 shows a perspective view of the upper part and of the lower part of the light tunnel and of the holder, FIG. 7 shows the light tunnel and holder in a view from behind, and FIG. 8 shows the lower part of the one-piece holder and light tunnel.

FIG. 1 shows a schematic view of an LED light module 1 for a motor vehicle or for a headlight for a motor vehicle, wherein the light module 1 comprises a lens 2 and also an LED print 20, on which (see FIG. 5) a primary LED light source 8 and a plurality of secondary LED light sources 9 are fitted.

The optical axis is denoted by 100.

Such an LED light module 1 for example produces a complete main light distribution, for example a dipped headlight beam, but preferably for example only a contribution to such a light distribution, for example the asymmetry portion in the dipped headlight beam distribution, whereas the rest of the light distribution is produced by other, additional light modules to which the description does not relate.

The same is true for the secondary light distribution; in this case too the light module according to the invention provides a contribution to the secondary light distribution.

The primary LED light source 8 in the example shown comprises four light-emitting diodes 8' (light outlet surfaces 8'), which are arranged in a housing 8".

The secondary LED light sources 9 in the example shown each comprise exactly one light-emitting diode 9', which is arranged in a housing 9".

As viewed in the light outlet direction, a light tunnel 11 for the direct passage of the light emitted from the primary LED light source 8 is provided between the primary LED light source 8 and the lens 2, wherein the light of the primary LED light source 8 exiting through the light tunnel 11 is projected into the area in front of the motor vehicle via the lens 2 in order to produce a main lighting function (where reference is made hereinafter or generally in this document to the "main lighting function" or the "main light" and similarly to the "secondary light", then "a portion" of the respective light distribution may therefore also be intended without this difference being detailed separately in each case).

The light emitted by such a primary LED light source, for example a high-power LED light source (for example LUMILED Altillin Core or OSTAR Headlamp) can be shaped by means of a light tunnel and projected via the lens 2, for example a free-form lens, aspherical lens, or Fresnel lens, onto the road, where it forms a main light distribution, for example a dipped headlight beam distribution (or, as mentioned, a specific portion thereof in the light exposure). Due to the use of a light tunnel 11, which has a specific length and of which the light outlet surface/opening 10 has a corresponding form (for example in order to shape an asymmetry portion in the light distribution), it is ensured that the light of the individual light-emitting diodes is well mixed and that the necessary homogeneous distribution is thus produced.

With such a headlight or light module, a secondary lighting function is now also to be produced, wherein it is to be ensured that the main light distribution is not impaired thereby, for example as a result of undesirable interfering radiation, which may be problematic in particular in the case of dipped light distributions. To this end, the light tunnel 11 is formed from a transparent material, and a holder 3 for holding the light tunnel 11 is also provided, wherein the holder 3 is likewise transparent.

The secondary LED light sources 9 are arranged with respect to the light tunnel 11 in such a way that the light emitted by the secondary LED light sources 9 is emitted substantially onto the holder 3 and passes therethrough and is imaged via the lens 2 as a secondary lighting function (for example a daytime running light) or as a contribution to this secondary lighting function.

The light tunnel 11 or the body 40, 41 forming the light tunnel 11 itself has a function that shadows the secondary lighting function, whereby a legally conforming light distribution for the secondary lighting function would not be produced. For this reason, the light tunnel 11 or the body, 40, 41 forming the light tunnel 11 is formed from a transparent material.

Since the light tunnel itself likewise is formed from a transparent material, wherein the light in the tunnel is preferably forwarded by means of total reflection, there is the risk however (in spite of total reflection) that light from the light tunnel 11 will pass into the transparent holder 3 and thus cause undesirable or legally inadmissible interfering radiation, which in particular may then often then be the case when the main lighting function is a dipped lighting function, such as a dipped headlight beam function, since this may result here in disallowed glare values above the HD line.

In order to prevent this, the wall of the light tunnel is light reflective, at least in the relevant areas, and therefore the risk of interfering radiation is eliminated. In the case of a light module with which two lighting functions are produced, these can therefore be produced in a legally conforming manner.

Due to the reflective embodiment (at least in some areas) of the inner wall 10', 11', 12' of the light tunnel 11, the interfering radiation can be reduced or completely eliminated.

Here, the wall 10', 11', 12' of the light tunnel 11 is to be understood to mean the inner wall of the body 40, 41 forming the light tunnel 11.

The entire inner wall 10', 11', 12', of the light tunnel 11 is preferably light reflective, that is to say both the inner wall 10' directly adjacent to the holder 3 and also the wall 11' extending forwards towards the light outlet opening 10 are reflective.

The wall 12' extending rearwardly, which comprises the primary LED light source 8 (and strictly speaking is no longer part of the light tunnel 11, but is referred to here as belonging to the light tunnel 11 for the sake of simplicity), is reflective. The wall 12' is designed geometrically in such a way that, where possible, no light from the primary LED light source irradiates outwardly or enters the holder 3, for which purpose said wall is stepped for example as shown. In order to completely block the light of the primary LED light source from entering the holder 3, the wall 12' is also reflective.

The light of the secondary LED light sources infiltrate the body 40, 41 forming the light tunnel (the body 40, 41 practically constitutes an optical waveguide) and passes through the reflective coating, but not into the light tunnel 11. Even without the reflective embodiment, the delimiting wall 10', 11', 12' of the light tunnel 11 would of course also be totally reflective to light from the secondary LED light sources, however a certain percentage of the light would still enter the light tunnel. This would be unproblematic however for the secondary lighting function, and the reflective embodiment of the light tunnel therefore is not necessary for the additional lighting function, but does not interfere or only interferes to a negligible extent due to the very low spatial expansion (thickness).

In accordance with the invention, it is possible to produce a secondary light distribution, for example a daytime running light distribution, by means of the secondary LED light sources 9. With the holder 3, the light tunnel 11 is held in its position on the one hand, and on the other hand the light originating from the secondary LED light source 9 can pass through the holder 3 and is imaged via the lens 2 as a secondary light distribution in an area in front of the vehicle.

As is indicated in FIG. 2 and as can be clearly seen in for example in FIGS. 3, 4 and 6, but also in FIGS. 7 and 8, the light tunnel 11 and the holder 3 are formed in one piece in one element, wherein this element itself in turn preferably consists of two parts 3*a*, 3*b*.

The elements 30, 30', 31, 31', which are preferably formed in one piece with the parts 3*a*, 3*b*, can be clearly seen in particular in FIGS. 3, 4 and 6. These elements are used to fasten the two parts 3*a*, 3*b* to one another.

The following is noted here with regard to the terminology:

*) the light tunnel 11 itself is indeed a through-opening in a transparent body 40, 41 (for example see FIG. 2); accordingly, the wording "light tunnel 11 formed in one piece with the holder 3" means that the body 40, 41 forming the light tunnel 11 is formed in one piece with the holder 3;

*) furthermore, as is already clear from above, the expression "in one piece" in "light tunnel 11 formed in one piece with the holder 3" does not necessarily mean that in fact only "one piece" or "one component" is present, but rather is intended to express the notion that the holder and light tunnel or the body 40, 41 forming the light tunnel are formed in a common component and that this component may also be formed in a two-part (or multi-part) design however; the two-part separation of this component does not however involve a separation between the light tunnel and the holder, but instead each of the components comprises a part of the holder and a part of the light tunnel, as can be clearly seen for example in FIG. 6.

The holder 3 (or the "one-piece element formed from the light tunnel and holder in the region of the holder) is clear, however the holder 3 may also be formed as a diffuser in order to obtain a particularly homogeneous light exposure of the secondary light distribution.

The wall 10', 11', 12' of the light tunnel 11 is primarily reflective at least in the wavelength range for visible light.

For example, the wall 10', 11', 12' of the light tunnel 11 is mirrored.

The wall 10', 11', 12', of the light tunnel 11 is preferably provided completely with a light-reflective layer, wherein it has been proven to be expedient in view of a possibility for simple production if the wall 10', 11', 12' of the light tunnel is vapour-coated with the light-reflective layer.

In particular for simple application of the reflective layer, it is advantageous if the "one-piece" component formed from the light tunnel 11 and holder 3 has a two-part design, wherein the separation planes 3*a*', 3*b*' between the two parts 3*a*, 3*b* run through the light tunnel 11. The respective elements are joined at these two separation planes.

The separation planes 3*a*', 3*b*' are preferably arranged through the holder/light tunnel in such a way that one of the two separation planes, in the example the upper separation plane 3*a*', constitutes a continuous planar surface, that is to say part of this planar surface forms the "ceiling" of the light tunnel (see FIG. 6), whereas the lower part 3*b* with the lower separation plane 3*b*' practically contains the entire light tunnel without ceiling. The separation is therefore formed in a position that is the uppermost possible position in this example and runs through the light tunnel. This separation has the advantage that, even if the two parts 3*a*, 3*b* are joined together in a slightly offset/shifted manner, no edges or steps, which would be imaged in the light exposure, are produced in the light tunnel itself.

If the separation were not performed at the uppermost (or lowermost) possible position through the light tunnel, but through the middle of the light tunnel, steps/edges would be produced in the light tunnel in the case of an offset assembly, as can be easily envisaged.

Since the separation planes 3*a*', 3*b*' run through the light tunnel 11, the wall 10', 11', 12' thereof can be optimally vapour-coated/coated.

The two separation planes 3*a*', 3*b*' are normally also vapour-coated with a light-reflective layer, which primarily results in a simpler fabrication process.

With regard to the optical function, it would be optimal here if merely the light tunnel, that is to say the inner wall thereof, were vapour-coated/coated. However, in the case of a one-piece embodiment of the light tunnel, said light tunnel could only be optimally vapour-coated/coated with difficulty, since the corresponding mist, for example an aluminium mist, would only distribute uniformly and completely in the light tunnel with difficulty (since the light tunnel is very small and narrow), whereby points with an excessively low coating thickness could be produced, which could in turn result in the risk of scattered light.

A two-part construction is accordingly selected, wherein a multi-part construction is also conceivable in principle, but would increase the costs. Only the tunnel itself (on the inner face) has to be reflectively coated. In order to save complex maskings (parts of the holder that are not to be coated would have to be covered), the entire separation surface/end face is coated. This has only a small influence photometrically, since this coating is very thin and increases the cost efficiency and process reliability.

Lastly, it is expedient if the primary LED light source 8 and the secondary LED light source 9 can be controlled separately, such that the primary light source and the secondary light source(s) can be switched on and off independently of one another.

The primary LED light 8 is dimmed during operation of the secondary LED light sources 9.

In the case of the secondary light, it is attempted to illuminate as far as the edge of the light tunnel 11 where possible with the light of the secondary light sources 9; the primary LED light source 8 is dimmed, but luminesces so that a continuous illumination is produced and the light tunnel does not produce a dark patch in the light exposure of the secondary light. The lens projects exactly that light distribution which occurs in its focal plane. Light of the secondary LED light sources cannot enter the tunnel, and this would therefore appear dark and would be represented as a dark point in a light exposure if the primary LED light source were not illuminated continuously (albeit in a dimmed manner).

In the main light mode, only the at least one primary LED light source is generally switched on, and the secondary LED light sources are normally switched off. In the case of a main lighting function=main beam, the secondary LED light sources could also be operated continuously however in order to emit more light onto the road.

The invention claimed is:

1. An LED light module (1) for a motor vehicle or for a headlight for a motor vehicle, wherein the light module (1) comprises a lens (2) and at least one primary LED light source (8), wherein, as viewed in the light outlet direction, a light tunnel (11) for the direct passage of at least a portion of the light emitted by the at least one primary LED light source (8) is provided between the at least one primary LED light source (8) and the lens (2), wherein the light, exiting through the light tunnel (11), of the at least one primary LED light source (8) is projected via the lens (2) into the region in front of the motor vehicle in order to produce a main lighting function or a contribution to a main lighting function, characterised in that the light tunnel (11) is a through-opening in a body (40,41), the body (40,41) at least partially comprising an optical transparent material, a holder (3) for holding the light tunnel (11) is provided, wherein the holder (3) is transparent at least in some areas, and wherein at least one secondary LED light source (9) is provided, which is arranged with respect to the light tunnel (11) in such a way that the light emitted by the at least one secondary LED light source (9) is emitted substantially onto the holder (3) and passes therethrough, wherein the light, passing through the holder (3), of the at least one secondary LED light source (9) is projected via the lens (2) into the region in front of the motor vehicle in order to produce a secondary light function, and wherein the wall (10', 11', 12') delimiting the light tunnel (11) is light-reflective at least in some areas, wherein the at least one primary LED light source (8) and the at least one secondary LED light source (9) are coplanar.

2. The light module according to claim 1, characterised in that the wall is light reflective at least in the area (10') adjacent to the holder (3).

3. The light module according to claim 1, characterised in that the at least one secondary LED light source (9) is arranged with respect to the light tunnel (11) in such a way that substantially no light flux of the at least one secondary LED light source (9) exits through the light tunnel (11).

4. The light module according to claim 1, characterised in that the holder (3) is formed at least in some areas as a diffuser.

5. The LED light module according to claim 1, characterised in that the entire area of the wall (10', 11', 12') of the light tunnel (11) is light-reflective.

6. The LED light module according to claim 1, characterised in that the wall (10', 11', 12') of the light tunnel (11) is light-reflective at least in the wavelength range for visible light.

7. The LED light module according to claim 1, characterised in that the wall (10', 11', 12') of the light tunnel (11) is mirrored.

8. The LED light module according to claim 1, characterised in that the wall (10', 11', 12') of the light tunnel (11) is provided in some areas or over its entire area with a light-reflective layer.

9. The LED light module according to claim 8, characterised in that the wall (10', 11', 12') of the light tunnel (11) is/are vapour-coated in some areas or over the entire area with a light-reflective layer.

10. The light module according to claim 1, characterised in that the light tunnel (11) and the holder (3) are formed in one piece.

11. The LED light module according to claim 1, characterised in that the light tunnel (11) and/or the holder (3) has/have a two-part design, wherein the separation planes (3*a*', 3*b*') between the two holder parts (3*a*, 3*b*) run through the light tunnel (11).

12. The LED light module according to claim 11, characterised in that the two separation planes (3*a*', 3*b*') of the light tunnel (11) and/or the holder (3) are likewise light-reflective.

13. The LED light module according to claim 1, characterised in that substantially the entire emitted, optically relevant light flux of the at least one primary LED light source (8) exits through the light tunnel (11) in order to produce the main lighting function.

14. The LED light module according to claim 1, characterised in that the at least one secondary LED light source (9) or all secondary LED light sources (9) lie outside the optical axis (100) of the light module.

15. The LED light module according to claim 1, characterised in that the at least one secondary LED light source (9) is arranged so as to be offset rearwardly with respect to the primary LED light source (8), against the light outlet direction.

16. The LED light module according to claim 1, characterised in that the primary LED light source (8) comprises two or more light-emitting diodes (8').

17. The LED light module according to claim 1, characterised in that the at least one primary LED light source (8) and the at least one secondary LED light source (9) or the at least one light-emitting diode (8') of the at least one primary LED light source (8) and the at least one light-emitting diode (9') of the at least one secondary LED light source (9) can be controlled separately.

18. The LED light module according to claim 1, characterised in that the at least one primary LED light source (8) is configured to be dimmed or switched off during operation of the at least one secondary LED light source (9).

19. The LED light module according to claim 1, characterised in that, when the light module is installed in a vehicle headlight, n secondary LED light sources (9) are provided below a horizontal plane through the primary LED light source (9) in the vertical direction and m secondary LED light sources (9) are provided above the horizontal plane in the vertical direction, wherein m<n.

20. The LED light module according claim 19, characterised by m=0.

21. The LED light module according to claim 19, characterised in that the secondary LED light source(s) (9) is/are arranged above or below the horizontal plane, in each case symmetrically in the horizontal direction about a vertical plane through the optical axis (100).

22. The LED light module according to claim 19, characterised in that further secondary LED light sources (6', 7') of the secondary light source are arranged laterally beside the primary LED light source (9).

23. The LED light module according to claim 1, characterised in that the dimensions of the light tunnel (11) and/or the arrangement of the at least one primary LED light source (8) with respect to the light tunnel (11) and/or the distance of the at least one primary LED light source (8) from the holder (3) are selected in such a way that all light rays emitted by the at least one primary LED light source (8) lying within an angular aperture of the lens (2) can pass through the light tunnel (11).

24. The LED light module according to claim 1, characterised in that the dimensions of the light tunnel (11) and/or the arrangement of the at least one secondary LED light source (9) with respect to the light tunnel (11) and/or the distance of the at least one secondary LED light source (9) from the holder (3) are selected in such a way that light rays from the at least one secondary LED light source (9) only reach those areas of the holder (3) lying outside the light tunnel (11).

25. The LED light module according to claim 24, characterised in that the dimensions of the light tunnel (11) in the diffuser (3) and/or the arrangement of the at least one secondary LED light source (9) with respect to the light inlet opening (10) of the light tunnel (11) and/or the distance of the at least one secondary LED light source (9) from the holder (3) are selected in such a way that light rays from the at least one secondary LED light source (9) are radiated as far as the edge of the light inlet opening (10) of the light tunnel (11).

26. The LED light module according to claim 1, characterised in that the light tunnel (11) is filled with an optically transparent material.

27. A vehicle headlight comprising at least one light module according to claim 1.

28. The LED light module according to claim 1, wherein the light tunnel (11) is formed from a material that is transparent over the entire area, and/or wherein the holder (3) is transparent over the entire area.

29. The LED light module according to claim 12, wherein the two separation planes (**3*a*', 3*b*'**) are totally light-reflective.

30. The LED light module according to claim 12, wherein the two separation planes (**3*a*', 3*b*'**) are provided with a vapour coated light-reflective layer.

31. The LED light module according to claim 26, wherein the optically transparent material is transparent in the range of visible light.

32. The LED light module according to claim 26, wherein the optically transparent material comprises silicone.

* * * * *